US005209514A

United States Patent [19]

Hebert

[11] Patent Number: 5,209,514

[45] Date of Patent: May 11, 1993

[54] I D CARD WITH BLOW ON LABEL

[75] Inventor: David L. Hebert, Suncook, N.H.

[73] Assignee: Moore Business Forms, Inc., Grand Island, N.Y.

[21] Appl. No.: 926,707

[22] Filed: Aug. 10, 1992

[51] Int. Cl.[5] ..... B42D 15/00

[52] U.S. Cl. ..... 283/81; 283/101; 283/106; 283/109; 40/630; 428/42

[58] Field of Search ..... 283/81, 94, 101, 106, 283/109; 40/625, 626, 630; 428/40, 41, 42

[56] References Cited

U.S. PATENT DOCUMENTS

| | | | |
|---|---|---|---|
| 3,068,140 | 12/1962 | Biddle | 156/227 |
| 3,505,140 | 4/1970 | Dunn | 156/249 |
| 4,351,474 | 9/1982 | Kaelblein et al. | 229/68 R |
| 4,510,006 | 4/1985 | Lawson | 156/235 |
| 4,597,814 | 7/1986 | Colgate, Jr. | 156/219 |
| 4,695,077 | 9/1987 | Pretre | 283/81 |
| 4,799,712 | 1/1987 | Biava et al. | 283/81 |
| 4,854,610 | 8/1989 | Kwiatek | 282/11.5 A |
| 4,911,477 | 3/1990 | Shishido | 283/100 |
| 4,982,894 | 1/1991 | Schmidt | 229/69 |
| 4,986,868 | 1/1991 | Schmidt | 156/249 |
| 5,129,682 | 7/1992 | Ashby | 283/81 |

*Primary Examiner*—Mark Rosenbaum
*Assistant Examiner*—Willmon Fridie, Jr.
*Attorney, Agent, or Firm*—Nixon & Vanderhye

[57] ABSTRACT

An identification card intermediate includes a transparent plastic substrate with a base stock and release liner each covering about half of the substrate. Indicia is printed on a first face of the base stock. A sticker, having indicia printed on a first face of it, is connected by repositional adhesive to the release liner. The release liner and base stock are connected by permanent adhesive to the plastic substrate. A number of stickers may be provided on the release liner, each including a phone number (e.g. different phone numbers), or providing basically the same information in different languages. An identification card is produced by removing the sticker from the release liner and placing it on the base stock, then removing the release liner from the substrate, and moving the substrate over the first face of the base stock. The intermediate of the identification card is produced by moving a web comprising the substrate with attachments, printing indicia on the stickers, and blowing at least one sticker on the release liner of each intermediate as the web is moving.

20 Claims, 2 Drawing Sheets

I D CARD WITH BLOW ON LABEL

BACKGROUND AND SUMMARY OF THE INVENTION

Identification cards, such as made by Moore Paragon in France since 1987, and such as shown in U.S. Pat. No. 4,695,077, desirably are constructed in a manner such that a transparent plastic substrate is connected by permanent adhesive to a base stock (bond paper) and a release liner, the base stock and release liner each covering approximately one half of the plastic substrate. The base stock has printing formed on it. By removing the release liner, the end user of the identification card—once the appropriate identification, signature, photo, or the like is provided on the base stock—moves the portion of the transparent plastic substrate previously covered by the release liner over the face of the base stock, thereby covering and protecting it, while still allowing the relevant information on the base stock to be viewed.

There are many times when it is desirable to provide labels or stickers on the identification card which have, for example, a phone number that the owner of the identification card can call if a particular service or product is needed, or to provide various variable information that may be unique to the desired end user (or a class of users). In the past, this has been done in a less than efficient manner.

In the prior art one manner in which stickers have been provided is to—in a mailing—provide a label or sticker distinct from the identification card, and have the ultimate user remove the label or sticker from whatever additional release liner it is associated with, and place it on the plastic substrate of the identification card. Alternatively, identification cards have been produced in which labels or stickers have been blown on to the plastic substrate of the intermediate, however these labels typically do not last very long because they get dirty and worn in normal use of the identification card (even merely being retained in a wallet). Sometimes, in the prior art, the labels have been sent in separate mailings from the identification cards, adding to the expense to the supplier of the cards, and additional trouble to the user.

Also, there are a number of situations where recipients of identification card intermediates may speak different languages. In the past the way that that has been approach is to print the information on the base stock in two (or more) languages greatly reduced in size. This makes the information less readable than desired, and/or takes up valuable space on the identification card where other indicia can be provided.

According to the present invention, the problems inherent in the prior art discussed above are remedied in a simple yet effective manner. According to the present invention an identification card intermediate is produced in which one or more stickers having desired information are blown on to the release liner of the intermediate, with indicia provided directly on the intermediate, or on another label or sticker blown on with the releasable sticker, giving instructions for removal and/or placement of the sticker. In this way, different stickers can be provided with, for example, different phone numbers, and the user can select whichever phone number is applicable to the end user. Also, different stickers can be provided having the same information in different languages, the information being entirely readily readable, and the end user can select the sticker with the language he or she is most comfortable with. In this way, by one mailing the end user can be provided with all necessary information and in a form that is readily utilizable, and effective for the end results desired.

According to one aspect of the present invention an identification card intermediate is provided. The intermediate comprises the following elements: A transparent plastic substrate having first and second edges parallel to each other, and third and fourth edges perpendicular to the parallel edges, and having first and second faces. A base stock having first, third, and fourth edges in substantial alignment with the substrate first, third, and fourth edges, respectively; and having first and second faces. Indicia printed on the first face of the base stock. A release liner having second, third, and fourth edges in substantial alignment with the substrate second, third, and fourth edges, respectively, and having first and second faces. An adhesive layer substantially covering the first face of the substrate, and connecting the second face of each of the base stock and the release liner to the substrate. The length of the third and fourth edges of each of the release liner and the base stock being approximately one half the length of the substrate third and fourth edges. And, a sticker having dimensions substantially less than the dimensions of the release liner, and having first and second faces, with releasable adhesive removably attaching the sticker second face to the release liner, and indicia printed on the sticker first face.

The releasable adhesive attaching the sticker second face to the release liner preferably is repositional adhesive, and indicia is provided on the release liner first face adjacent the sticker—either printed directly on the release liner, or on another sticker—providing instructions on utilization of the sticker. Preferably a plurality of stickers are provided on a release liner, and the indicia on the stickers includes a phone number, such as different phone numbers on each of two different stickers associated with the intermediate. Also, the indicia on the base stock may include indicia indicating where the sticker should be placed on the base stock first face. The sticker may be dimensioned so as to fit on, yet be readily visible on, a telephone handpiece. Also, different stickers may have basically the same indicia in different languages, so that the end user may remove and utilize the sticker having the language that he or she feels most comfortable with.

According to another aspect of the present invention, a method of making an identification card intermediate is provided. The method comprises the following steps: (a) Moving in a first direction a web comprising a transparent plastic substrate having adhesive on a first face thereof, with a base stock covering a first side of the first face, and a release liner covering a second side of the first face, opposite the first side, formed into a plurality of continuous, interconnected identification card intermediates. (b) Printing indicia on each of a plurality of stickers, each having an adhesive face. And, (c) blowing at least one sticker on the release liner of each intermediate as the web is moving in the first direction so that the adhesive on the sticker adhesive face releasably attaches it to the release liner. Typically step (a) is practiced by engaging tractor drive holes in the substrate along the first and second sides thereof, and step (b) is practiced to print a telephone number on the stickers.

Also, step (c) is preferably practiced to blow on a plurality of stickers on to each intermediate release liner, and step (b) may be practiced to print different telephone numbers on different stickers applied to each intermediate release liner.

According to yet another aspect of the present invention, an identification card is provided comprising the following elements: A transparent plastic substrate having a first face with permanent adhesive thereon, and having a length and a width. A base stock having about one half the length of the substrate and approximately the same width, and having a first face with indicia thereon, and a second face. A sticker having dimensions substantially less than that of the base stock, and indicia printed on a first face thereof, and repositional adhesive attaching the sticker second face to the base stock first face. And, the plastic substrate being folded over the base stock so that the permanent adhesive attaches the substrate to both the first and second faces of the base stock, so that the substrate substantially completely covers the base stock, with the base stock first face indicia and the sticker indicia, visible through the plastic.

It is the primary object of the present invention to provide an identification card intermediate which in a self-contained manner provides all of the components that the user of the identification card requires, including stickers that may be readily positioned where desired on the identification card, and then protected by a plastic component of the intermediate; as well as a method of producing the intermediate, and an identification card so produced. This and other objects of the invention will become clear from an inspection of the detailed description of the invention and from the appended claims.

DETAILED DESCRIPTION OF THE DRAWINGS

Figure 1:
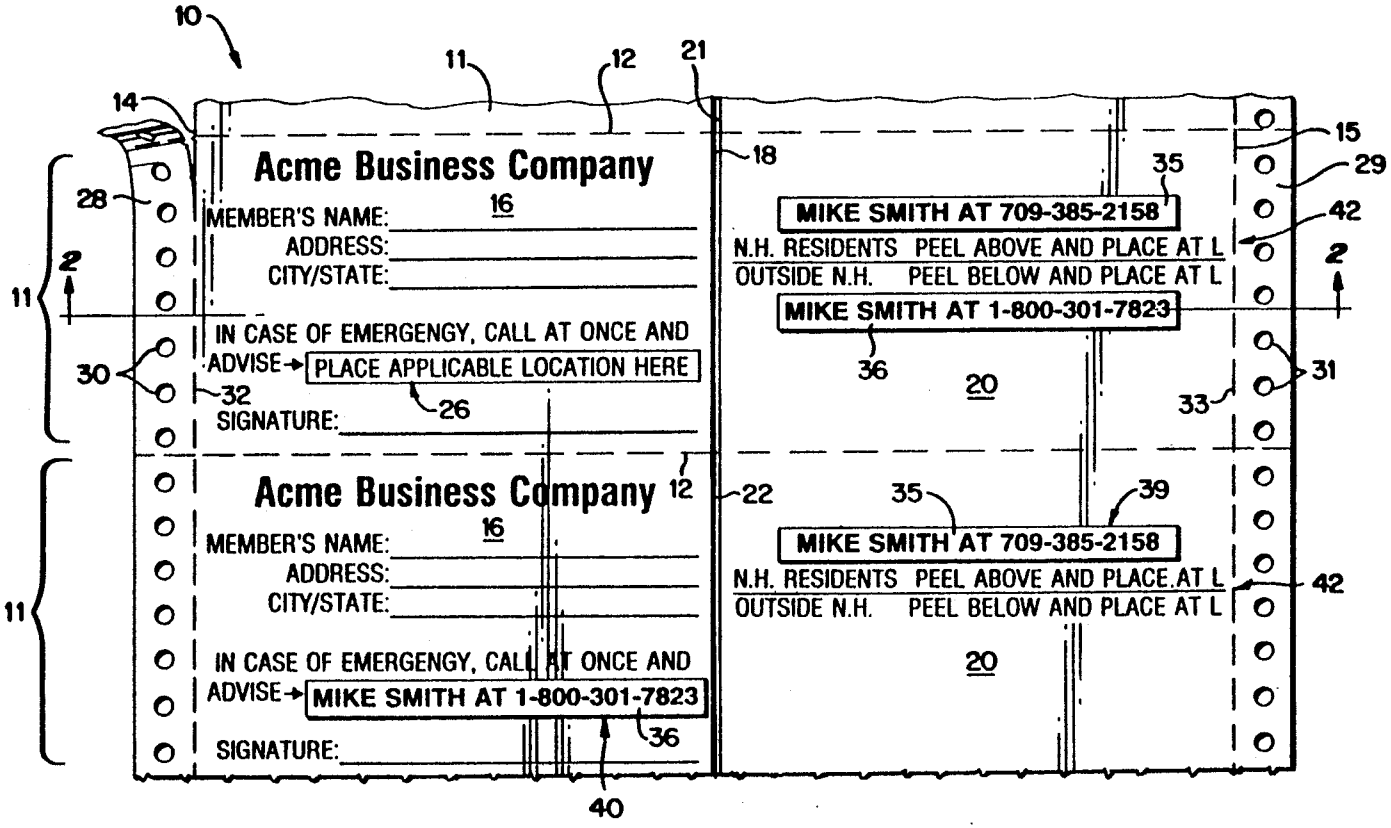
FIG. 1 is a top plan view of a plurality of identification card intermediates according to the present invention illustrated in continuous form.

A plurality of identification card intermediates, disposed in continuous form, are illustrated generally by reference numeral 10 in FIG. 1. As is conventional, such as provided by Moore Paragon of France since 1987, and as shown in FIGS. 1 and/or 2, each intermediate 11 is separated by a perforation line 12 from other intermediates 11. Each intermediate 11 includes a transparent plastic substrate 13 having a first edge 14 and an opposite, parallel second edge 15, and having third and fourth edges defined by the perforation lines 12. The edges 14, 15 are perpendicular to the edges defined by the perf lines 12. A base stock 16, such as of bond paper, is connected by permanent adhesive layer 17 to the substrate 15, and has first, third, and fourth edges aligned with the edges 14, and perf lines 12 of the substrate 15, and a second edge 18 parallel to the edge 14 and at an intermediate portion of the substrate 13. Adjacent the base stock 16, and also connected by the adhesive 17 to the substrate 13, is a release liner 20, having second, third, and fourth edges aligned with the edges 15 and perf lines 12 of the substrate 13, and having a first edge 21 parallel to the edge 15, and parallel to the edge 18 of the base stock 16 and spaced only a short distance therefrom, a gap 22 being defined between the edges 18, 21. The release liner 20 is of typical release material which will not permanently adhere to the adhesive 17, such as a waxed or silicone coated paper.

The base stock 16 has indicia 24 printed on the first, top, face 25 thereof while its second, bottom, face is held by the adhesive 17 to a first face of a plastic substrate 13. The indicia 24 can include indicia 26 which suggests placement of a sticker having an emergency phone number at a particular location on the first face 25 of the base stock 16, the phone number being different for different recipients of the intermediate 11 so that all the intermediates 11 cannot merely be printed with the phone number. Also, detachable tractor drive strips 28, 29 may be provided along the edges 14, 15, having tractor drive openings 30, 31 therein, and separated from the main bodies of the intermediates 11 by lines of weakness (such as perforations or die cuts) 32, 33.

Figure 2:
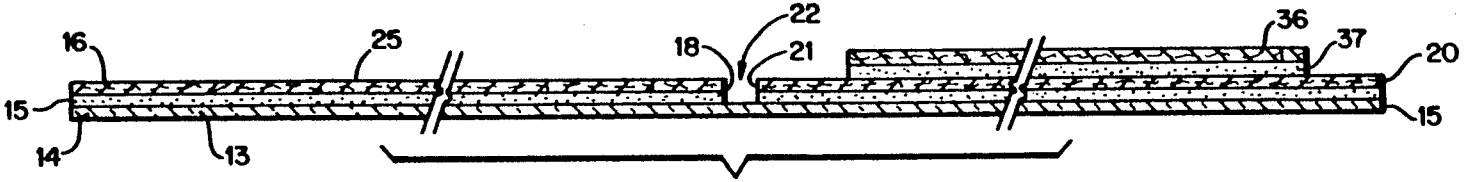
FIG. 2 is a cross-sectional view of an intermediate of FIG. 1 taken along lines 2—2 thereof.

What has been describes heretofore is conventional. What is new according to the invention is the provision of one or more stickers 35, 36 on the release liner 20 which are connected by releasable adhesive 37 to the top face of the release liner 20 (see FIG. 2). The releasable adhesive 37 may be any adhesive that will not adhere to the release liner 20, but—so that both faces of the release liner 20 need not be waxed or silicone coated—it is preferred that the adhesive 37 be repositional adhesive, such as used in the commercially available "NOTE STIX"® products sold by Moore Business Forms, Inc. of Lake Forest, Illinois, or by Moore under the trademark "CLEAN-TAC", or by 3M of Minneapolis, Minnesota under the trademark "POST-IT"®. The stickers 35, 36 are preferably blown on to the release liner 20 as the web containing the continuous form intermediates 11 is being driven by a tractor drive, utilizing the openings 30, 31. The blow on equipment is conventional label blow on equipment.

The stickers 35, 36 have indicia 39, 40 printed on the top face thereof. Preferably, a plurality of different stickers 35, 36 are provided on the release liner 20 for each intermediate 11—as seen in in FIG. 1—and different phone numbers are provided on the different stickers 35, 36, for example the phone number indicated by indicia 39 being the phone number for New Hampshire residents who receive the intermediate 11, while the phone number provided by indicia 40 being the phone number for non-New Hampshire residents receiving the intermediate 11. As shown schematically for the bottom intermediate 11 in FIG. 1, it is desired that the end user of the intermediate 11 remove one of the stickers 35, 36 and place it over the indicia 26.

Also according to the invention, it is desirable to have indicia 42 printed either directly on the release liner 20, or on other stickers which are blown onto the release liner 20, that is immediately adjacent the stickers 35, 36, and provides instructions on utilization of the stickers 35, 36.

Figure 3:
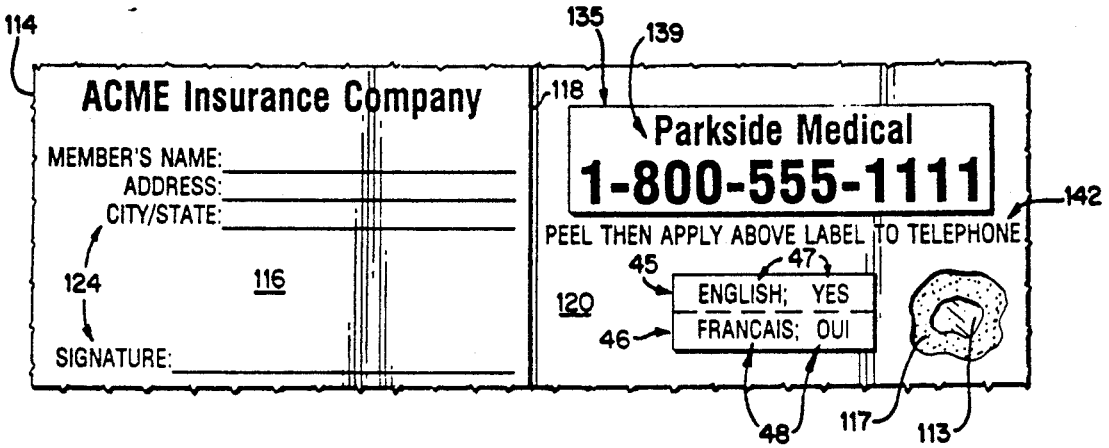
FIG. 3 is a top plan view of a modified form of identification card intermediate according to the invention.

FIG. 3 illustrates another form of intermediate according to the invention. In the embodiment of FIG. 3 components comparable to those in the FIG. 1 embodiment are shown by the same reference numeral only preceded by a "1".

The intermediate 111 has the base stock 116, release liner 120, plastic substrate 113, and permanent adhesive 117. On the release liner 120 is a first sticker 135 which has a phone number indicia 139 thereon. The sticker 135 is dimensioned so that it will fit on a telephone handpiece, yet is readily visible. Repositional adhesive (not shown) attaches the sticker 135 to the release liner 120.

Also illustrated in the embodiment of FIG. 3 are additional stickers 45, 46 which are like the stickers 35, 36 except that instead of having phone numbers printed thereon they have basically the same information but printed in different languages. For example the sticker 45 has indicia 47 in the English language, while the sticker 46 has indicia 48 having essentially the same meaning as the indicia 47, only it is in the French language. This allows the user to apply whichever label 45, 46 to the base stock 116 that he or she feels comfortable with, yet the stickers 45, 46 can be printed so that the indicia 47, 48 is very legible, and need not be greatly reduced in order to get the same information in two or more languages within a given space.

Figure 4:
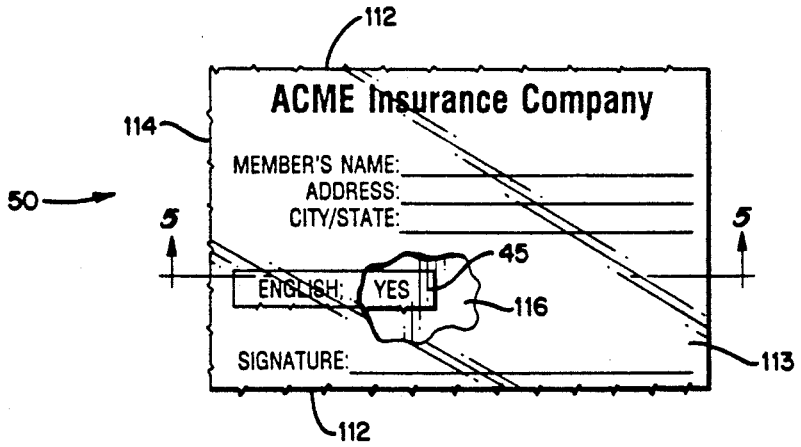
FIG. 4 is a top plan view of the intermediate of FIG. 3 constructed into an identification card.
Figure 5:
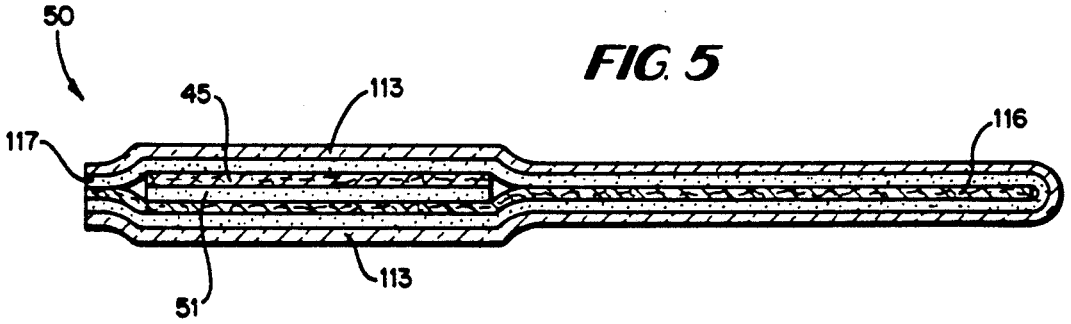
FIG. 5 is a cross-sectional view of the identification card of FIG. 4 taken along lines 5—5 thereof.

FIGS. 4 and 5 illustrate an identification card 50 according to the present invention which is constructed from the intermediate 111. In this case, the sticker 135 has been removed and placed on a telephone handpiece, the sticker 45 has been selected by this particular user and placed on a substrate 116, attached by adhesive 51 to the base stock 116. The release liner 120 has been removed and the portion of the transparent plastic substrate 113 that it previously covered has been folded over the top of the base stock 116, covering and protecting it.

It will thus be seen that according to the present invention a very desirable identification card intermediate is provided, one having great flexibility, minimizing the number of mailings or components within a mailer to provide the desired information and component parts to the end user, and produced in a simple yet effective way. The invention also contemplates an identification card produced with the novel intermediate.

While the invention has been herein shown and described in what is presently conceived to be the most practical and preferred embodiment it will be apparent to those of ordinary skill in the art that many modifications may be made thereof within the scope of the invention, which scope is to be accorded the broadest interpretation of the appended claims so as to encompass all equivalent structures, devices, and procedures.

What is claimed is:

1. An identification card intermediate comprising:

a transparent plastic substrate having first and second edges parallel to each other, and third and fourth edges perpendicular to said parallel edges, and having first and second faces;

a base stock having first, third, and fourth edges in substantial alignment with said substrate first, third, and fourth edges, respectively; and having first and second faces;

indicia printed on said first face of said base stock;

a release liner having second, third, and fourth edges in substantial alignment with said substrate second, third, and fourth edges, respectively, and having first and second faces;

an adhesive layer substantially covering said first face of said substrate, and connecting said second face of each of said base stock and said release liner to said substrate;

the length of said third and fourth edges of each of said release liner and said base stock being approximately one half the length of said substrate third and fourth edges; and a sticker having dimensions substantially less than the dimensions of said release liner, and having first and second faces, with releasable adhesive removably attaching said sticker second face to said release liner, and indicia printed on said first face.

2. An intermediate as recited in claim 1 wherein said releasable adhesive is repositional adhesive.

3. An intermediate as recited in claim 2 further comprising indicia printed on said release liner first face adjacent said sticker providing instructions on utilization of said sticker.

4. An intermediate as recited in claim 3 further comprising at least one additional sticker having dimensions substantially less than the dimensions of said release liner, and having first and second faces, with releasable adhesive removably attaching said sticker second face to said release liner, and indicia printed on said first face.

5. An intermediate as recited in claim 4 further comprising additional indicia printed on said release liner first face adjacent said additional sticker, and providing instructions on utilization of said additional sticker.

6. An intermediate as recited in claim 5 wherein the indicia on said stickers includes a phone number.

7. An intermediate as recited in claim 1 wherein the indicia on said sticker includes a phone number.

8. An intermediate as recited in claim 7 wherein said indicia on said base stock includes indicia indicating where said sticker should be placed on said base stock first face.

9. An intermediate as recited in clam 1 wherein said base stock is of bond paper, and said indicia on said base stock includes indicia indicating where said sticker should be placed on said base stock first face.

10. An intermediate as recited in claim 1 further comprising at least one additional sticker connected by repositional adhesive to said release liner and having indicia printed on a first face thereof; and wherein said indicia on said stickers includes a different phone number on each sticker.

11. An intermediate as recited in claim 1 wherein the indicia on said sticker includes a phone number and wherein said sticker is dimensioned so as to fit on, yet be readily visible on, a telephone handpiece.

12. An intermediate as recited in claim 1 in combination with a plurality of substantially identical other intermediates connected together in continuous form at said third and fourth edges thereof, and including detachable tractor drive strips along said first and second edges of said substrate.

13. A combination of intermediates as recited in claim 12 wherein the indicia on said stickers of said intermediates comprises phone numbers, and wherein some of said stickers have different phone numbers than others of said stickers of said intermediates in said combination.

14. An intermediate as recited in claim 1 wherein said sticker comprises a first sticker, and further comprising at least one additional sticker substantially identical to said first sticker, and having indicia corresponding to indicia on said first sticker except in a different language than the language of the indicia on said first sticker.

15. A method of making an identification card intermediate, comprising the steps of:

(a) moving in a first direction a web comprising a transparent plastic substrate having adhesive on a first face thereof, with a base stock covering a first side of the first face, and a release liner covering a second side of the first face, opposite the first side, formed into a plurality of continuous, interconnected identification card intermediates;

(b) printing indicia on each of a plurality of stickers, each having an adhesive face; and (c) blowing at least one sticker on the release liner of each intermediate as the web is moving in the first direction so that the adhesive on the sticker adhesive face releasably attaches it to the release liner.

16. A method as recited in clam 15 wherein the stickers have repositional adhesive.

17. A method as recited in claim 15 wherein step (a) is practiced by engaging tractor drive holes in the substrate along the first and second sides thereof.

18. A method as recited in claim 15 wherein step (b) is practiced to print a telephone number on the stickers.

19. A method as recited in claim 18 wherein step (c) is practiced to blow a plurality of stickers onto each intermediate release liner, and wherein step (b) is practiced to print different telephone numbers on different stickers applied to each intermediate release liner.

20. An identification card, comprising:

a transparent plastic substrate having a first face with permanent adhesive thereon, and having a length and a width;

a base stock having about one half the length of said substrate and approximately the same width, and having a first face with indicia thereon, and a second face;

a sticker having dimensions substantially less than that of said base stock, and indicia printed on a first face thereof, and repositional adhesive attaching said sticker second face to said base stock first face; and said plastic substrate being folded over said base stock so that said permanent adhesive attaches said substrate to both said first and second faces of said base stock, so that said substrate substantially completely covers said base stock, with said base stock first face indicia and said sticker indicia, visible through said plastic.

* * * * *